US007520076B2

(12) United States Patent
Flagg

(10) Patent No.: US 7,520,076 B2
(45) Date of Patent: Apr. 21, 2009

(54) DOUBLE SIDED TABLE TOP DISPLAY APPARATUS

(76) Inventor: Rodger H. Flagg, 10504 Daysailer Dr., Fairfax Station, VA (US) 22039

( * ) Notice: Subject to any disclaimer, the term of this patent is extended or adjusted under 35 U.S.C. 154(b) by 342 days.

(21) Appl. No.: 11/546,345

(22) Filed: Oct. 12, 2006

(65) Prior Publication Data

US 2007/0028493 A1 Feb. 8, 2007

Related U.S. Application Data

(63) Continuation-in-part of application No. 10/673,432, filed on Sep. 30, 2003, now Pat. No. 7,140,134.

(51) Int. Cl.
*A47B 5/00* (2006.01)
*G09F 5/02* (2006.01)

(52) U.S. Cl. ..... 40/607.14; 108/152

(58) Field of Classification Search ..... 108/90, 108/60, 61, 50.01, 152; 211/180; 312/196; 248/231.71, 229.25; 40/607.14
See application file for complete search history.

(56) References Cited

U.S. PATENT DOCUMENTS 3,494,405 A * 2/1970 Bartelmas et al. ..... 160/24
3,517,822 A * 6/1970 Wagner ..... 211/11
5,609,112 A * 3/1997 Meyer et al. ..... 108/158.13
6,568,535 B1 * 5/2003 Pylant ..... 206/713
D546,184 S * 7/2007 Yelland ..... D9/502

* cited by examiner

*Primary Examiner*—Cassandra Davis

(57) ABSTRACT

A double sided table top display apparatus having a first double sided upright sub-assembly, a second double sided upright sub-assembly, and upper and lower horizontal cross-members, which extend between the first and second double sided upright sub-assemblies, to substantially span the desired length of the table top. A one or more horizontal cross member extension(s) may be selectively used to extend the length of the display apparatus for longer displays. A flexible sheet material with indicia thereon is releasably secured to the modular table top display apparatus at assembly, and may be rolled up for transport or storage. A rotatable clamp extends beneath the table top to secure each of the first and second upright sub-assemblies directly to the table top. Optional lighting may be supported by the rigid frame. The modular table top display apparatus my be disassembled and compactly stored in a carrying case or bag, for ease of transport and storage.

19 Claims, 8 Drawing Sheets

DOUBLE SIDED TABLE TOP DISPLAY APPARATUS

CROSS-REFERENCE TO RELATED TOPICS

This patent application is a continuation-in-part of utility patent application Ser. No. 10/673,432 entitled MODULAR TABLE TOP DISPLAY APPARATUS, filed Sep. 30, 2003 now U.S. Pat No. 7,140,134, by Rodger H. Flagg, wherein a Notice of Allowance has been received, and is hereby incorporated by reference herein.

STATEMENT REGARDING FEDERALLY SPONSORED RESEARCH

Not Applicable.

REFERENCE TO SEQUENCE LISTING A TABLE, OR A COMPUTER PROGRAM LISTING COMPACT DISK APPENDEX

Not Applicable.

BACKGROUND OF THE INVENTION

There are many types of display devices known in the art. One popular type of display device is known as the pop-up display. Pop-up displays have been adapted for floor use as well as for table top use. These devices have multiple arms which pivot and expand to support graphics or other indicia. They are light weight, compact and portable, but require a foot print that takes up hundreds of square inches of the available table area, and are expensive to make.

There are rigid panel displays, which fold for transport or storage, and fold out to rest upon a table top. These also take up substantial table space when erected upon a table, and viewing from the side is partially restricted.

There are vertical roll-up displays. Vertical roll up displays have no means to secure the display to a tabletop, and thus are usually used from the floor and not adapted for securement to a tabletop. Roll up displays are best used indoors, as the vertical sides of the display are not supported, and tend to twist and flutter in the wind.

Inflatable displays are also known, which are supported from the floor. These displays are very compact when deflated, but will deflate during use, if accidentally punctured, and require a large footprint to support the display.

Rigid frames have been used to support graphics or indicia. Rigid frames are usually supported upon a wall, or other vertical support, and will easily fall over in a gust of wind, if placed upon a table top without additional support.

Many trade shows and conventions take place in Hotels, Convention Centers, and indoor or outdoor common areas. The vendor is often limited in usable display space to a six foot or eight foot long table. Some trade shows require the vendor's display to be placed only upon the table top, and restrict use of floor mounted displays.

Therefore, what is needed is a compact, portable double sided display apparatus, which is attractive and eye catching, is easily set up or taken down without tools, requires a minimum of table top space, is clamped directly to the tabletop and not supported from the floor, requires a minimum footprint on the table top, is adjustable to suit the length of the table top, provides optional lighting, the first and second double sided upright sub-assemblies providing improved strength and ease of assembly, and the double sided table top display apparatus designed to withstand gusts of wind without falling down.

SUMMARY OF THE INVENTION

The present invention relates to a double sided table top display apparatus having a first double sided upright sub-assembly, a second double sided upright sub-assembly, and upper and lower horizontal cross-members sized to extend between the first and second double sided upright sub-assemblies, to span the desired length of the table top. A flexible sheet material with indicia thereon is releasably secured to the modular table top display apparatus at assembly, and may be rolled up for transport or storage. First and second rotating clamp arms extend beneath the table top to releasably secure respective first and second double sided upright sub-assemblies directly to the table top. Optional lighting may be supported by the rigid frame. The double sided table top display apparatus may be disassembled and compactly stored in a carrying case or bag, for ease of transport and storage.

DETAILED DESCRIPTION OF THE PREFERRED EMBODIMENT(S)

Figure 1:
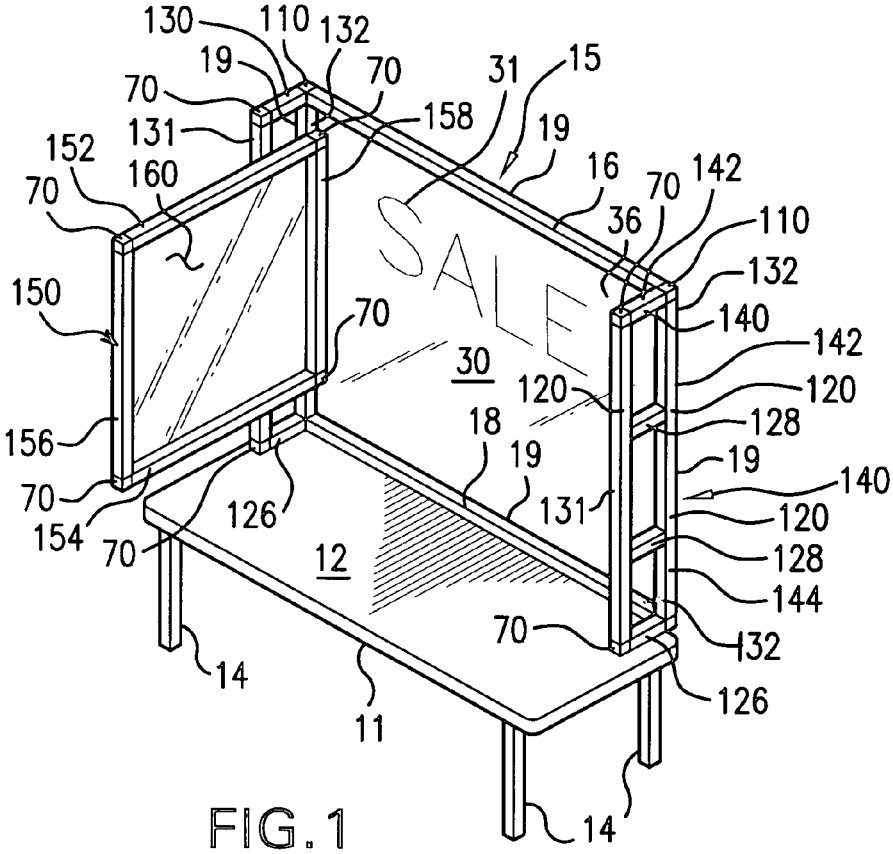
FIG. 1 is a front perspective view of the double sided table top display apparatus mounted upon a tabletop, with first and second double sided upright sub-assemblies, projection framework with flexible screen mounted to one of the first and second double sided upright sub-assembly, upper and lower horizontal cross members, and a flexible dispay sheet releasably secured on the back side of the back vertical tubular members located on the first and second double sided table top apparatus.

As shown in FIG. 1 through FIG. 8, the double sided table top display apparatus 100 is easily configured to substantially fit the length of a new or existing table 11, having a table top 12. The frame 15 is made of tubular members 19, which are each preferably square or rectangular in shape, although other shapes, such as round, oblong or multi-sided may alternately be used. The tubular members 19 are preferably made of aluminum for strength and light weight, although other metals or plastics may alternately be used without departing from the scope of this invention, or from the following claims.

Straight connectors 60, right angle connectors 70, three way connectors 110, tee connectors 120 and four-way connectors 80 are selectively used to connect the double sided table top display apparatus 100 at assembly.

Upper and lower horizontal cross-members 16, 18 extend between the first double sided upright sub-assembly 130 and the second double sided upright sub-assembly 140. More than one end to end upper horizontal cross-members 16, and more than one end to end lower horizontal cross-members 18 may be releasably joined together at assembly with a slip fit connection 61 to provide a variety of lengths to suit the desired length of the double sided table top display apparatus 100. (See FIG. 3).

For example, one approximately three foot long upper horizontal cross member 16 and one three foot long lower horizontal cross member 18 may be used to make a three foot long double sided table top display apparatus 100, or two approximately three foot long upper horizontal cross members 16 and two lower horizontal cross members 18 may be joined with a straight connector 60 to make a six foot long upper and lower horizontal cross members 16, 18. Alternately, one approximately six foot long upper horizontal cross member 16 and one lower horizontal cross member 18 may be used to make a six foot long double sided table top display apparatus 100.

Likewise, one approximately five foot long upper horizontal cross member 16 and and one five foot long lower horizontal cross member 18 may be used to make a five foot long double sided table top display apparatus 100. Two approximately five foot long end to end upper horizontal cross members 16 and two approzimately five foot long lower end to end horizontal cross members 18 may be joined together with a straight connector 60 to make a ten foot long double sided table top display apparatus 100. Likewise, one approximately eight foot long upper horizontal cross member 16 and one approximately eight foot long lower horizontal cross members 18 may be used to make an approximately eight foot long double sided display apparatus.

Figure 3:
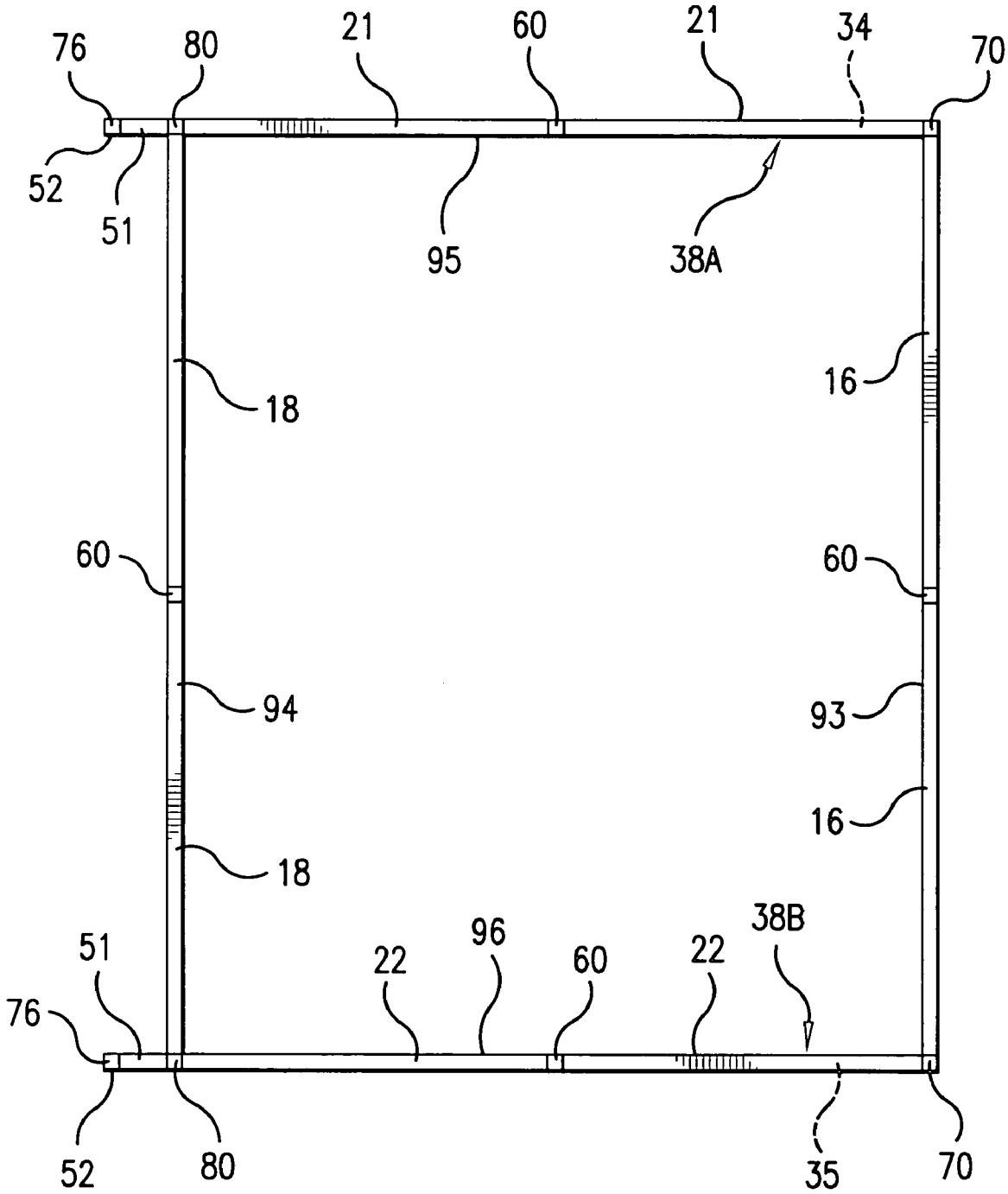
FIG. 3 is a front view of the double sided table top display apparatus showing the use of more than one upper horizontal cross members; the use of more than one lower horizontal cross members; and the use of upper and lower front and rear vertical tubular members on each of the first and second double sided upright sub-assemblies.

Alternately, two four foot long upper horizontal cross members and two four foot long lower horizontal cross members may be joined together to make an approximately eight foot long double sided display apparatus. Thus, any combination of lengths of upper and lower horizontal cross members 16, 18 may be used and releasably connected together to fit a selected table top 12 length. Two end to end upper horizontal cross members 16 are shown in FIG. 3. Likewise, two end to end lower horizontal cross members 18 are shown in FIG. 3. Preferably, an elastomeric cord 66 joins two adjacent upper horizontal cross members 16 together, for ease of assembly. Likewise, an elastomeric cord 66 joins two adjacent lower horizontal cross members 18 together, for ease of assembly. The elastomeric cord 66 may be secured either directly to the cross members 16, 18 or to adjoining connectors, to suit manufacturing preference. When used, the elastomeric cords 66 serve to keep adjacent cross members together during assembly, and simplify alignment of complimentary parts during assembly.

Likewise, where upper and lower front vertical tubular members 21 and upper and lower rear vertical tubular members 22 are used in each of the first and second double sided upright sub-assemblies 130, 140, they may each be joined together with a straight connector 60. The front and back vertical members 131, 132 are each preferably joined together at assembly with a slip fit connection 61 for ease of assembly and disassembly. The front and back vertical members 131, 132 may each be divided into two or more upper and lower vertical portions 142, 144 to provide a variety of heights to suit the desired height of the double sided table top display apparatus 100. An elastomeric cord 66 may be secured either directly to the upper or lower vertical portions 142, 144 or to the adjoining connector 60, to suit manufacturing preference. When used, the elastomeric cords 66 serve to keep adjacent upper and lower vertical portions 142, 144 together during assembly, and simplify alignment of complimentary parts.

Figure 4A:
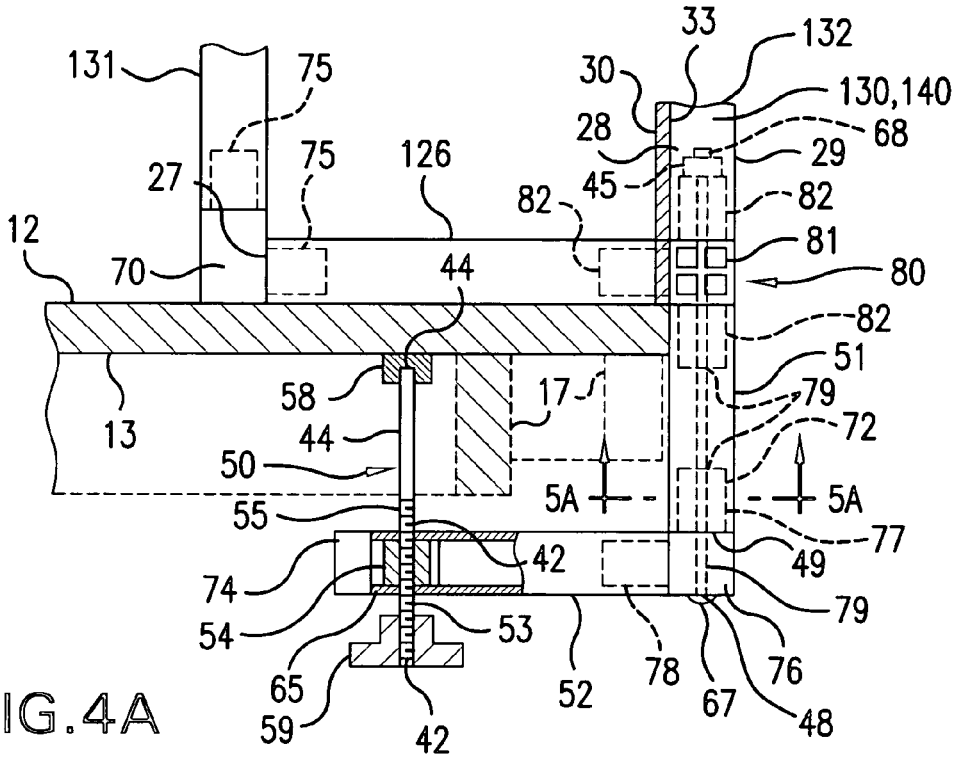
FIG. 4A is a partial side view of one of the first and second double sided upright sub-assemblies, showing the clamping means releasably secured beneath the table top, and the flexible display sheet mounted to the front side of the rear vertical tubular members on one of the first and second double sided upright sub-assemblies.

FIG. 4A shows a partial side view of the first double sided upright sub-assembly 130, showing in detail the table top cross brace 126, and the horizontal clamping arm 52 pivotally aligned with the rear vertical tubular member 132 located on the first double sided upright sub-assembly 130. The horizontal clamping arm 52 is connected to a lower extension 51. The horizontal clamping arm 52 is either rigidly secured 46 or pivotally secured 48 to the lower end 49 of lower extension 51 beneath the table top 12. Preferably, the horizontal clamping arm 52 is pivotally secured 48 to aid in positioning the clamping means 50 on the underside of the table top 13 to avoid obstacles located on the underside of the table top 13. The horizontal clamping arm 52 is preferably sized to position the camping means 50 between the front vertical member 131 and the back vertical member 132 of the respective first or second upright sub-assembly 130, 140 of the double sided table top display apparatus 100.

Figure 4B:
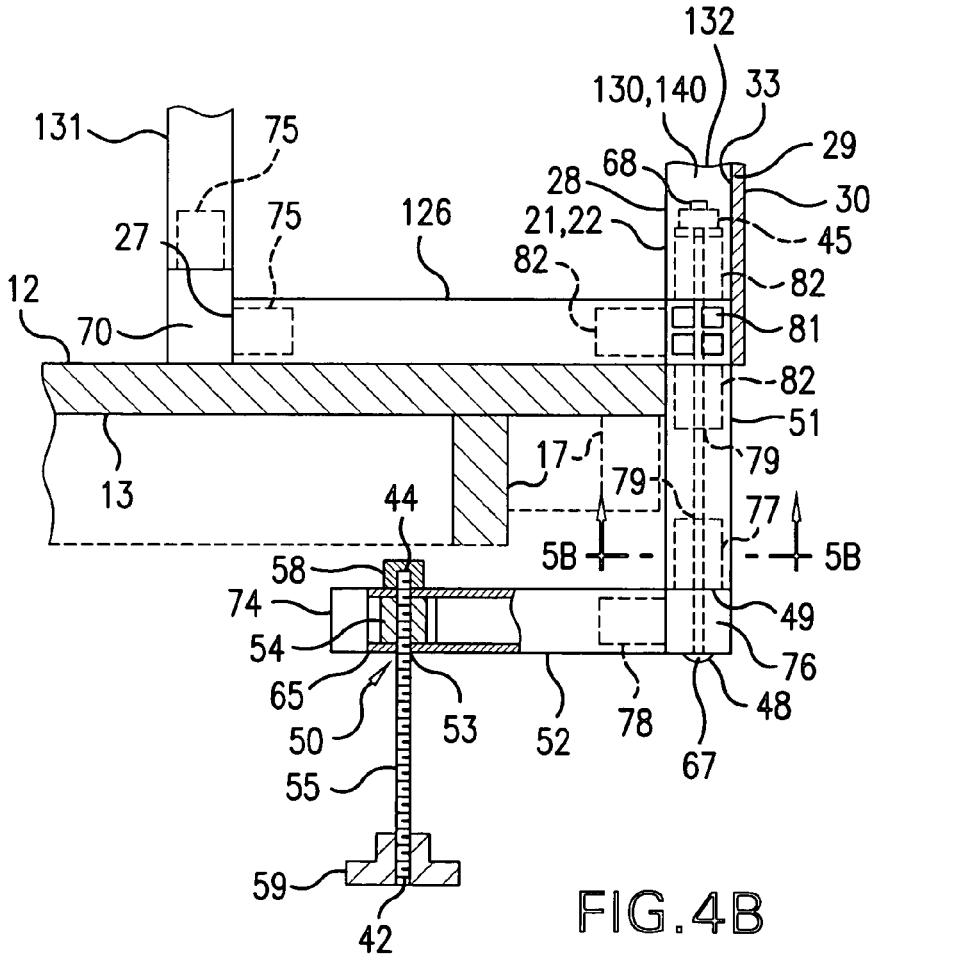
FIG. 4B is a partial side view of one of the first and second double sided upright sub-assemblies, showing the clamping means lowered to clear the depending lip of the table top, and the flexible display sheet mounted to the back side of the rear vertical tubular members on one of the first and second double sided upright sub-assemblies.
Figure 5A:
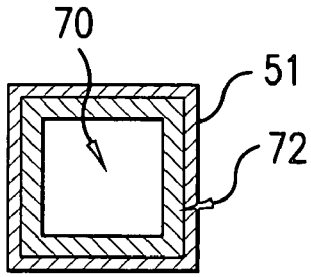
FIG. 5A is a cross sectional view of a non-pivoting clamping arm taken along lines 5-5 in FIG. 4.
Figure 5B:
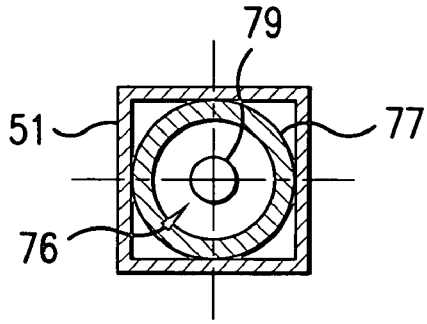
FIG. 5B is a cross sectional view of a pivoting clamping arm taken along lines 5-5 in FIG. 4.
Figure 5C:
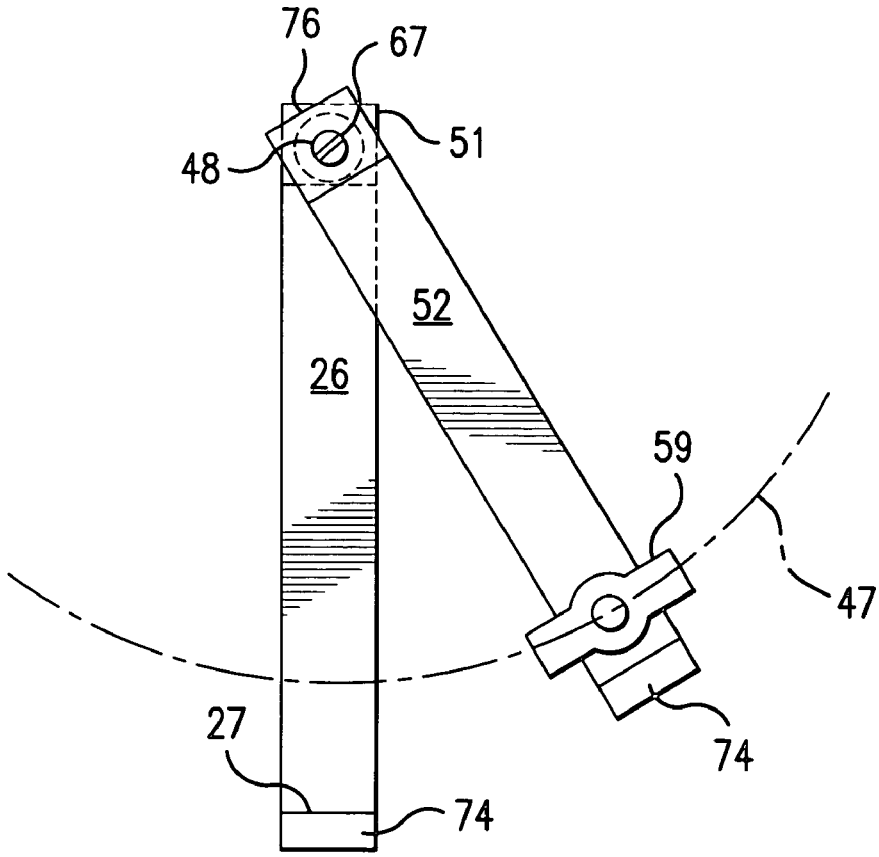
FIG. 5C is a bottom view of the horizontal clamping arm adapted to pivot to avoid obstructions located beneath the tabletop, to obtain a more suitable clamping position.

As shown in FIG. 4A and FIG. 4B, a vertical aperture 53 extends through the horizontal clamping arm 52 at a position near the distal end 65 of the clamping arm 52. A threaded nut 54 is secured within the clamping arm 52, in alignment with the vertical aperture 53. A threaded rod 55 threadably engages the threaded nut 54, and extends through the vertical aperture 53. A handle 59 is secured to the lower end 42 of the threaded rod 55. When the handle 59 is rotated in a first direction, the threaded rod 55 selectively raises to engage the underside of the table top 13, to releasably secure the double sided table top display apparatus 100 to the table top 12.

When the handle 59 is rotated in the opposite direction, the threaded rod 55 is lowered to clear the depending lip 17 of the table top 12. The upper portion 44 of the threaded rod 55 may be undercut to slip through the threaded nut 54 without engaging the threads, to more rapidly position the threaded rod 55 in proximity to the underside of the table top 13. The remaining threads on the threaded rod 55, are positioned to engage the threads on the threaded nut 54 as the distal end 68 of the threaded rod 55 comes near the underside of the table top 13.

Figure 6:
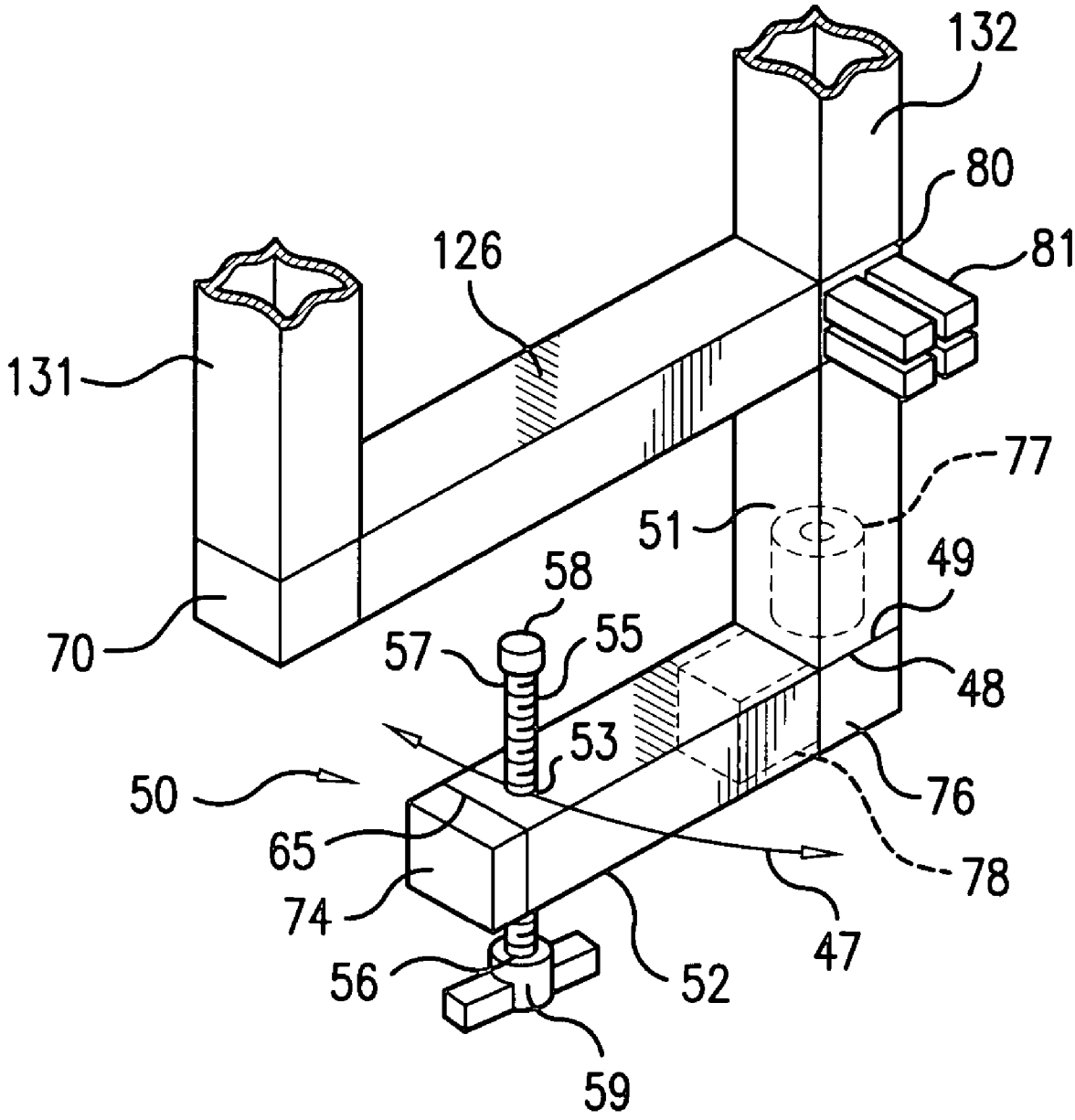
FIG. 6 is a partial front perspective view of one of the first and second double sided upright sub-assemblies showing the horizontal clamping arm positioned inline with the first rear vertical tubular member, and the horizontal clamping arm adapted to pivot to avoid obstructions located beneath the tabletop.
Figure 7A:
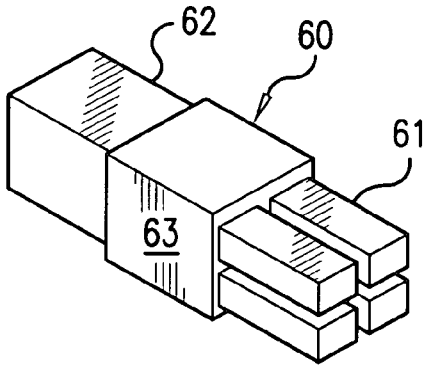
FIG. 7A is a perspective view of a straight connector, with a slip fit end and an opposing press fit end.
Figure 7B:
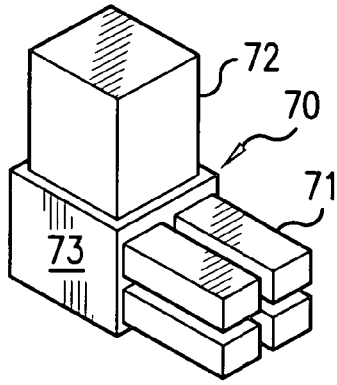
FIG. 7B is a perspective view of a right angle connector, with a slip fit end and an opposing press fit end.
Figure 7C:
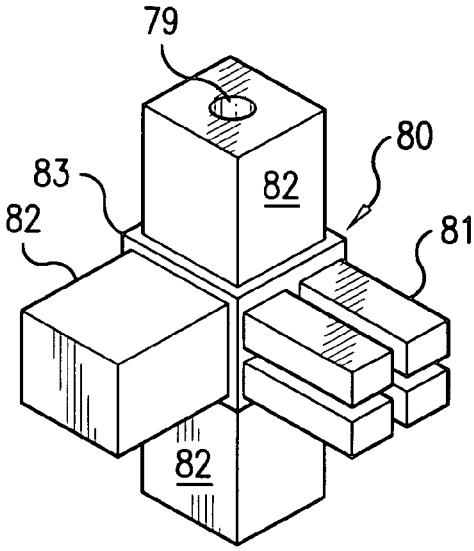
FIG. 7C is a perspective view of a four way connector with a slip fit side connection, and three press fit ends, with a vertical aperture extending therethrough.
Figure 7D:
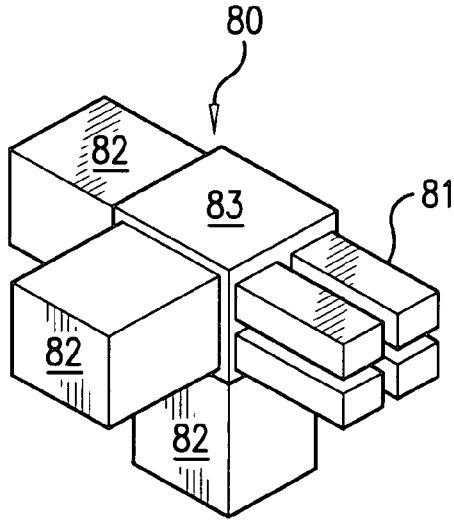
FIG. 7D is a perspective view of an alternate four way connector with a combination of slip fit and press fit end connectors.
Figure 7E:
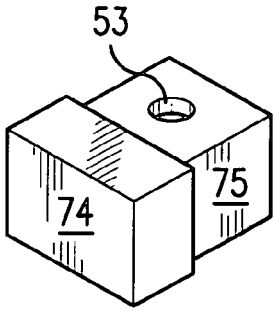
FIG. 7E is a perspective view of an end connector with a vertical aperture extending therethrough.
Figure 7F:
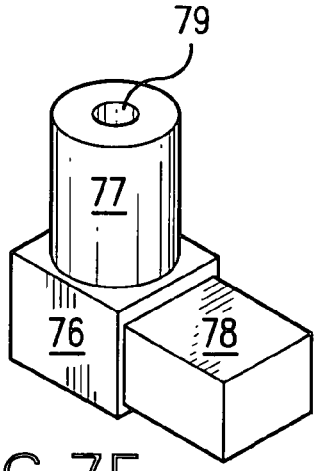
FIG. 7F is a perspective view of a pivoting right angle connector, with a press fit end and a cylindrical slip fit end with an aperture extending therethrough.
Figure 7G:
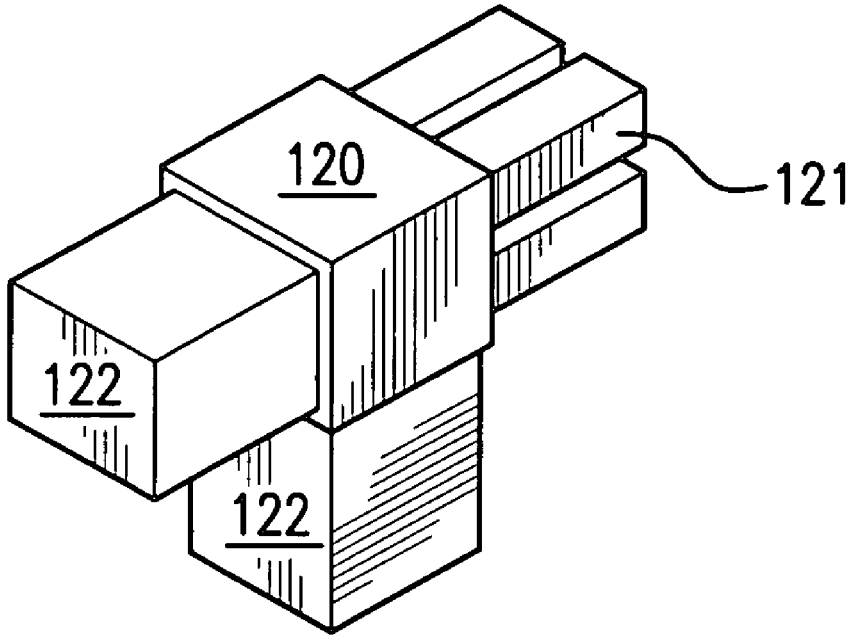
FIG. 7G is a perspective view of a tee connector with a combination of slip fit and press fit end connectors.
Figure 7H:
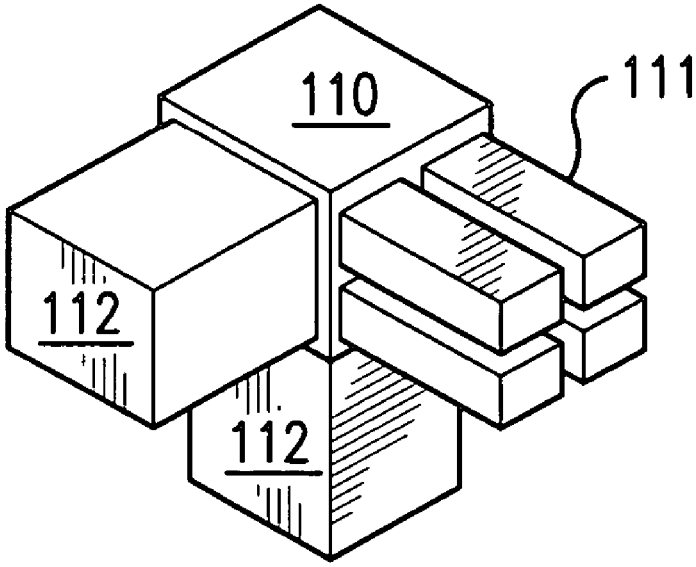
FIG. 7H is a perspective view of a three way connector with a combination of slip fit and press fit end connectors.

The clamping means 50 may extend directly below the table top cross brace 126 of the first or second double sided upright sub-assembly 130, 140 as shown in FIG. 6, or the clamping means 50 may be offset from the table top cross brace 126 of the first or second double sided upright sub-assembly 130, 140 to better avoid obstacles located beneath the table top 12, as shown in pending patent application, incorporated herein by reference. (Note that many existing table tops 12 have the lower lip 17 located in different locations on the underside of the table top 13). The horizontal clamping arm is preferably rotated to better avoid obstacles located beneath the table top.

On most existing table top 12 assemblies, the lower lip 17 extends flush, or up to three and one half inches from the outer edge of the table top 12, and extends up to three inches below the underside of the table top 13. Thus, the offset clamping means 50 is preferably positioned to avoid such obstacles located beneath most existing table tops 12. See FIG. 4A and FIG. 4B.

The double sided table top display apparatus 100 is sized to fit upon the selected table top 12, with a height of the double sided table top apparatus 100 sized to receive the flexible sheet material 30 to be displayed thereon. Most banner manufacturers have sign printing machines capable of making flexible sheet material 30 sixty inches or more in width. Alternately, flexible sheet material 30 may be made by joining two or more panels of flexible sheet material 30 together with a seam (not shown) to create the desired height of the flexible sheet material 30. Any suitable length may be printed by most sign printing machines.

Preferably the double sided table top display apparatus 100 is sized to extend from one to six inches less than the length of the table top 12, to ensure a better clamping location when the first and second upright sub-assemblies 130, 140 are releasably secured to the table top 12.

The height of the double sided table top display apparatus 100 is dependent on the height of the front and back vertical members 131, 132 used in the respective first and second upright sub-assemblies 130, 140. The front and back vertical members 131.132 are used for the respective first and second upright sub-assemblies 130, 140 and may each be configured with upper and lower vertical portions 142, 144 and joined by one or more straight connectors 60. The straight connectors 60 may have a slip fit connection on one side to more easily releasably join two or more sections or front and back vertical members 131, 132 together at assembly. Other known means of releasable securement may alternately be used, without departing from the scope of this specification, or the following claims. This reduces the overall size of the dismantled double sided table top display apparatus 100, which is beneficial for transport and storage.

Additional intermediate cross braces 128 may be joined to the respective front and back vertical members 131, 132 to reinforce and stiffen the respective first and second upright sub-assemblies 130, 140. A tee connector 120, three way connector 110, or four way connector 80 may be selectively used in place of a straight connector 60 to join the front and back vertical members 131, 132 or the upper and lower vertical members 142, 144 to suit the configuration desired.

Preferably, a slip fit connection 61, 71, or 81 is selected for use for ease of assembly and disassembly at locations where the double sided table top display apparatus 100 is intended to separate for ease of transport or storage.

The flexible sheet material 30 has a front side 38A and a back side 38B sized to fit the desired height and length of the frame 15, and is pliable so that it may be easily rolled up for ease of transport and storage. The flexible sheet material 30 may be a flexible or pliable plastic, fabric, paper or cloth material on which graphics and other indicia 31 may be printed, painted, drawn, or otherwise secured thereon. A commercially available vinyl or fabric material 36 is preferably used. The indicia 31 may be any color or combination of colors, and may include photo image(s), printed matter, letters, numbers, symbols, names, trademarks, etc.

When unrolled, the flexible sheet material 30 is releasably secured to the frame 15 of the double sided table top display apparatus 100 along the first opposing side 38A or the second opposing side 38B of the front or rear vertical members 131. 132 as shown in FIGS. 4A and 4B; and to the respective upper and lower horizontal cross members 16, 18. The flexible sheet material 30 is drawn taught and releasably secured with a releasable securement means 33, such as hook and loop type fasteners, magnetic strips, clamps, double sided releasable adhesive, or other known releasable securement means 33. The releasable securement means 33 may be positioned in continuous or spaced positions along the frame 15 and along complimentary sides of the flexible sheet material 30.

A first and/or second rigid member 34 such as a bar, rod, angle, or other selected elongated shape may be used on at least one of the front and rear sides 28, 29 of the flexible sheet material 30 for ease of assembly. The rigid member(s) 34 are preferably releasably secured with a suitable releasable securement means 33 to one side 38A or 38B of the flexible sheet material 30.

At assembly, one of the rigid member(s) 34 is positioned at one of the opposing sides 38A, 38B of the frame 15, and then the flexible sheet material 30 is drawn taut and releasably secured to the opposing side 38A, 38B of the frame 15. When not in use, the flexible sheet material 30 may be rolled up upon the rigid member(s) 34 and may be stored with other component parts of the modular table top display assembly 10, or rolled and placed in a separate container, to suit user preference.

FIG. 4A is a partial side view of the double sided table top apparatus 100 showing the rotating clamping arm 76 for releasably securing the first and second double sided upright sub-assemblies 130, 140 to the table top 12, with the flexible sheet material 30 releasably secured to the front side 28 of the first and second double sided upright sub-assemblies 130, 140.

The rotating clamping arm 76 is rotatably secured to a lower vertical extension 51 secured beneath the back vertical tubular member 144 of one of the first and second double sided upright sub-assembly 130, 140. A pivoting connector 77 is inserted into the lower end 49 of lower vertical extension 51 (shown in FIG. 5B), and a horizontal clamping arm 52 is press fit into the second end 78 of the pivoting connector 77. A vertical aperture 79 extends through the pivoting connector 77 to receive a threaded rod or bolt 67. The threaded rod or bolt 67 extends through the lower extension 51 and through an aperture 79 in the connector 80 shown in FIG. 7C, and is held in place with a suitable nut 45, preferably a locknut. The horizontal clamping arm 52 also has a vertical aperture 53 extending through the clamping arm 52 near the distal end 65 of the horizontal clamping arm 52. The vertical aperature 53 is sized to slidably receive a threaded rod 55 therein. A threaded nut 54 is secured within the horizontal clamping arm 52 in alignment with the vertical aperture 53. A threaded rod 55 threadably engages the threaded nut 54. The lower end 42 of the threaded rod 55 is secured to a handle 59, so that when the handle 59 is rotated, the threaded rod 55 selectively rises or lowers in relation to the threaded nut 54. A cap 58 may be provided at the upper end 44 of the threaded rod 55, as shown in FIG. 4A and FIG. 4B to avoid marring the underside 13 of the table top 12 when the threaded rod 55 is tightened against the underside 13 of the table top 12. Preferably, the cap 58 does not rotate with rotation of the threaded rod 55.

Preferably, the horizontal clamping arm 52 is pivotally secured 48 with a threaded bolt 67 and a nut 45 extending through the lower vertical extension 51, as shown in FIG. 4B. The horizontal clamping arm 52 is pivoted to better position the threaded rod 55 to avoid obstacles located beneath the table top 12. (Also see FIG. 5B and FIG. 5C). Arrow 47 in FIG. 6 shows the pivoting direction of the horizontal clamping arm.

Figure 2:
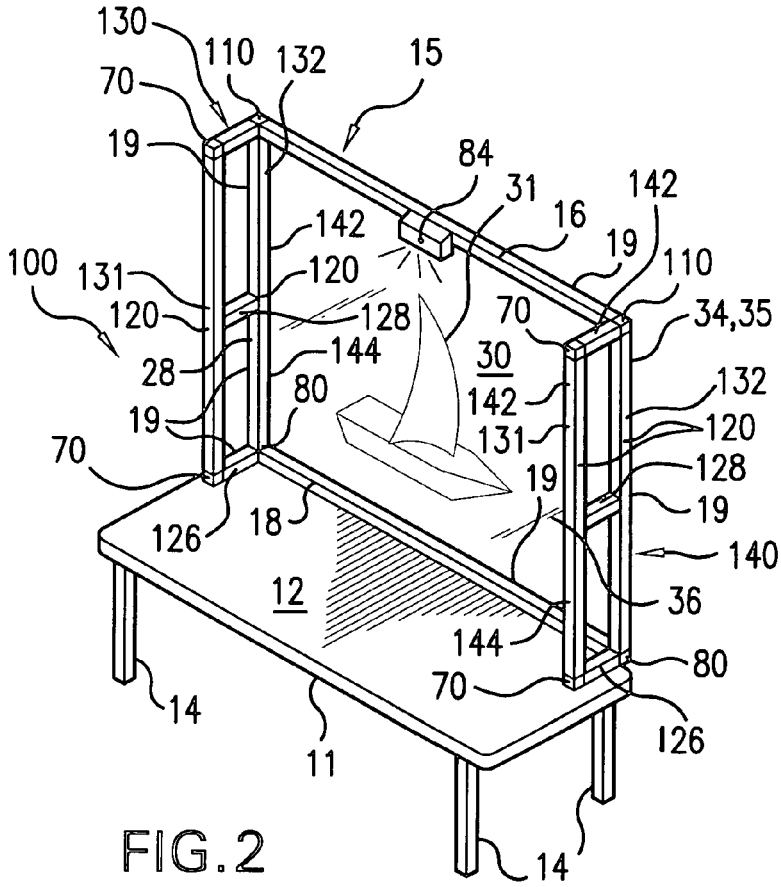
FIG. 2 is a front perspective view of the double sided table top display apparatus mounted upon a tabletop, with first and second double sided upright sub-assemblies, upper and lower horizontal cross members, and a flexible display sheet releasably secured on the front side of the back vertical tubular members located on the first and second double sided table top display apparatus.

The double sided table top display apparatus 100 is supported upon a suitable table top 12, as shown in FIG. 1 and FIG. 2. The double sided table top display apparatus 100 comprises a first upright sub-assembly 130, with at least one front vertical member 131 and at least one back vertical member 132. In the embodiment shown in FIG. 1, a three way connector 110 is secured to the upper end of the back vertical member 132, and a right angle connector 70 is secured to the upper end of the front vertical member 131. A lower four way connector 80 is secured to the lower end of the back vertical member 132, and a right angle connector 70 is secured to the lower end of the front vertical connector 131. Where the first and second upright sub-assemblies 130, 140 are divided into upper and lower vertical portions 142, 144, a suitable connector 60, 80, is selected to enable a slip fit connection therebetween.

A first clamping means 50 may be positioned beneath the first double sided upright sub-assembly 130. The first clamping means 50 includes a horizontal table top cross brace 126 extending between the front and back vertical members 131, 132, a depending lower extension 51, and a horizontal clamping arm 52 with a vertical aperture 53 located near the distal end 65 of the horizontal clamping arm 52. A threaded nut 54 is secured within the horizontal clamping arm 52 in alignment with the vertical aperture 53. A threaded rod or bolt 55 engages the threaded nut 54, and the threaded rod 55 extends through the vertical aperture 53. A handle 59 is secured to the threaded rod 55 at a location beneath the horizontal clamping arm 52.

The threaded rod 55 is sized to engage the underside of the table top 13 when the handle 59 is tightened, and to clear the depending lip 17 of the table top 12 when the handle 59 is loosened. A cap 58 preferably covers the distal end of the threaded rod 55, to avoid marring the underside of the table top 13.

A second clamping means 50 is positioned beneath the second upright sub-assembly 140. The second clamping means 50 includes a horizontal table top cross brace 126 extending between the front and back vertical members 131, 132, a depending lower extension 51, and a horizontal clamping arm 52 with a vertical aperture 53 located near the distal end 65 of the horizontal clamping arm 52. A threaded nut 54 is secured within the horizontal clamping arm 52 in alignment with the vertical aperture 53. A threaded rod or bolt 55 engages the threaded nut 54, and the threaded rod 55 extends through the vertical aperture 53. A handle 59 is secured to the threaded rod 55 at a location beneath the horizontal clamping arm 52. See FIG. 4A, FIG. 4B and FIG. 5C for a pivotally secured 48 clamping means 50.

The first double sided upright sub-assembly 130 has a front vertical member 131 and a back vertical member 132 which are spaced apart by one or more cross braces 126, 128. A three way connector 110 is secured to the upper end of the back vertical member 132, and a right angle connector 70 is secured to the upper end of the front vertical member 131. A lower four way connector 80 is secured to the lower end of the back vertical member 132, and a right angle connector 70 is secured to the lower end of the front vertical connector 131. Where the first and second upright sub-assemblies 130, 140 are divided into upper and lower vertical members 141, 143, a suitable connector is preferably used to enable a slip fit connection 61 therebetween.

The second double sided upright sub-assembly 140 has a front vertical member 131 and a back vertical member 132 which are spaced apart by one or more cross braces 126, 128. A three way connector 110 is secured to the upper end of the back vertical member 132, and a right angle connector 70 is secured to the upper end of the front vertical member 131. A lower four way connector 80 is secured to the lower end of the back vertical member 132, and a right angle connector 70 is secured to the lower end of the front vertical connector 131. Where the first and second upright sub-assemblies 130, 140 are divided into upper and lower vertical members 141, 143, a suitable connector is selected to enable a slip fit connection therebetween.

At least one upper horizontal cross member 130 is sized to extend between a three way connector 110 secured to the upper end 23 of the first double sided upright sub-assembly 130 and a right angle connector 70. A complimentary three way connector 110 is secured to the upper end 23 of the second double sided upright sub-assembly 140 to receive the opposite end of the horizontal cross member 142.

At least one lower horizontal cross member(s) 126 is sized to extend between a four way connector 80 secured to the lower end of the first double sided upright sub-assembly 130 and a complimentary four way connector 80 secured to the lower end of the second double sided upright sub-assembly 140.

Figure 8A:
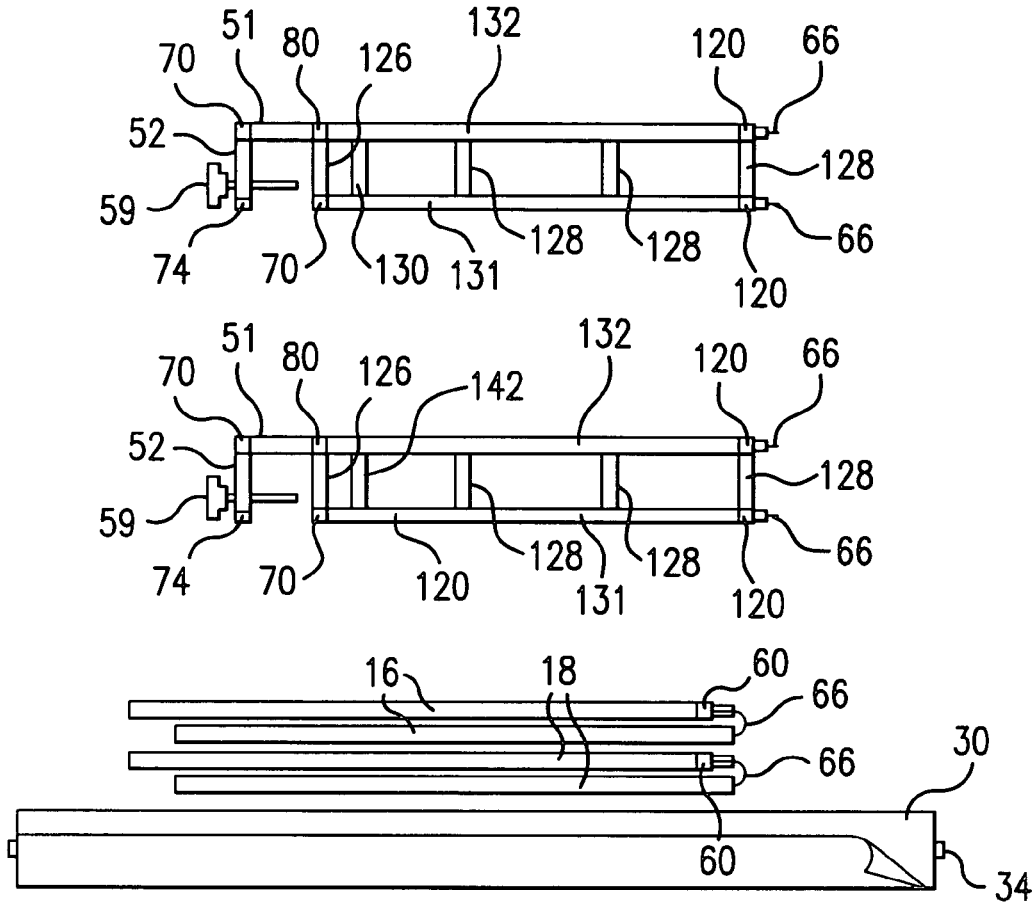
FIG. 8A is a top view of the double sided table top display apparatus disassembled and folded prior to insertion into a carrying case.
Figure 8B:
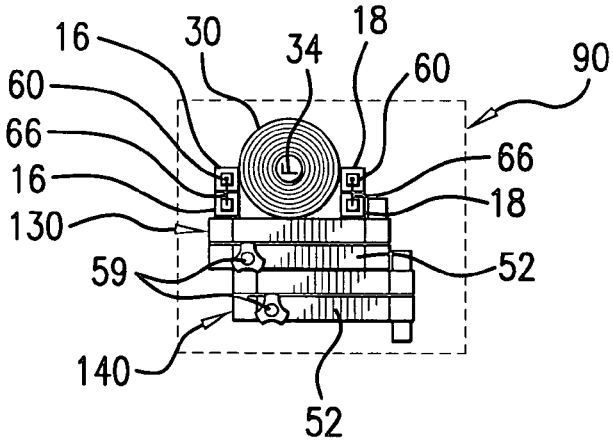
FIG. 8B is an end view of the carrying case with the double sided table top display apparatus, enclosed therein.

A flexible sheet material 30 is sized to be releasably secured to the vertical tubular member 142 on the first upright sub-assembly 120, the vertical tubular member 132 on the second upright sub-assembly 140, the upper horizontal cross member(s) 16 and the lower horizontal cross member(s) 18. The flexible sheet material 30 may be rolled up when not in use, for ease of transport and storage. A rigid member 34 may be positioned on one or both of the opposing sides 38A, 38B of the flexible sheet material 30 for ease of assembly. The flexible sheet material 30 may be rolled up around the rigid member 34 for ease of transport and storage, as shown in FIG. 8B.

The horizontal clamping arms 52 of the first and second upright sub-assemblies 130, 140 are preferably pivotally secured 48 with a suitable fastener 67 in relation to the respective first and second upright sub-assemblies 130, 140, to better position the clamping means 50 to avoid various obstacles located on the underside of the table top 13.

More than one end to end vertical tubular member(s) 21, 22 may be used to extend the height of the respective first and second upright sub-assemblies 130, 140, and to provide a more compact disassembly, for ease of transport or storage.

Likewise, more than one end to end horizontal cross member(s) 16, 18 may be used to extend the length of the double sided table top display apparatus 100 to provide a more compact disassembly, for ease of transport or storage.

One or more light fixtures 84 may be releasably secured to the upper portion of the frame 15, or to the cross brace 128 on the first and/or second double sided upright sub-assembly 130, 140 to provide improved lighting to the double sided table top display apparatus 100. A multiple light cord assembly 86 may alternately be used as noted in the pending patent application.

A slip fit connection 61, 71, 81 is preferably provided for ease of assembly and disassembly. The slip fit connection 61, 71, 81 may be molded, cut, ground, or machined to provide a suitable slip fit connection 61, 71, 81, 111 and 121.

As shown in FIG. 4A and FIG. 4B, an end connector 74 is preferably provided to close off the distal end 65 of each horizontal clamp arm 52. The end connector 74 on the horizontal clamp arm 52 may also aid in securing the threaded nut 54 within the distal end 65 of the horizontal clamp arm 52, as shown in FIG. 4A and FIG. 4B.

The lower extension 51 and the horizontal clamp arm 52 are preferably pivotally secured 48 in line in relation to the back vertical member 132, 142 on each of the first and second double sided upright sub-assemblies 130, 140. See FIG. 6.

A projection framework 150 may be releasably secured with bolts, screws, clamps or other releasable securement means (not shown) to one of the first and second double sided upright subassemblies 130, 140 as shown in FIG. 1. The projection framework 150 comprises an upper horizontal member 152, a lower horizontal member 154, a left side vertical member 156 and a right side vertical member 158 joined together at their ends with right angle connectors 70 to form a projection framework 150. A flexible projection screen 160 is stretched across the projection framework 150. Suitable apertures or brackets (not shown) may be provided in the projection framework 150 for ease of mounting and removing the projection framework 150 from the first or second double sided upright sub-assemblies 130, 140.

The projection screen 160 is positioned to allow a user to project an image from a remote projection apparatus (not shown) positioned on the table top 12 which may be adapted to project images and messages from a remote computer and/or projector (not shown). The projection framework 150 is preferably sized to suit the image size to be projected. One typical framework 150 size is 3:4, with the projection apparatus positioned about twice the distance from the projection framework 150 in relation to the desired width of the projection framework 150.

The double sided table top display apparatus 100 disclosed herein is easily assembled and disassembled without the use of tools. The component parts may be easily disassembled and brought together for storage in a suitable container or bag 90, for ease of transport or storage.

When needed, the double sided table top display apparatus 100 may be quickly assembled upon a table top 12. The component parts are removed from the container 90, and the first and second double sided upright sub-assembly 130, 140 are each assembled. Then horizontal cross members 16, 18 are then assembled to the respective connectors on the first and second double sided upright sub-assemblies 130, 140. The flexible sheet material 30 is then aligned, drawn taught and secured to the tabletop display frame 15, either on the back side 23 of the tabletop display frame 15 as shown in FIG. 4B, or on the front side 25 of the tabletop display frame 15, as shown in FIG. 4A.

The assembled tabletop display frame 15, with flexible sheet material 30 assembled thereon, is then raised to a vertical position with the table top braces 126 positioned on the table top 12 as shown in FIG. 1 or FIG. 2. The user then secures the first and second clamping means 50 beneath the table top 12, to secure the entire double sided table top display assembly 100 to the table top 12 as shown in FIG. 4A. Lighting 84 may be added as needed, either before or after installing the double sided table top display apparatus 100 upon the table top 12.

To remove the assembled frame 15, the first and second clamping means 50 are each loosened as shown in FIG. 4B, and the assembled tabletop display frame 15 is lowered into a horizontal position, on either the floor or upon the table top 12. The flexible sheet material 30 is then removed from the frame 15, and rolled up. The horizontal cross members 16, 18 are then removed from the first and second double sided upright sub-assemblies 130, 140, and the component parts are then dis-assembled and placed in a suitable container 90, for shipping or storage, as shown in FIG. 8B.

Thus, while a preferred embodiment of the double sided table top display apparatus 100 has been disclosed, one of average skill in this art may make numerous changes and modifications without departing from the scope of this invention, and such changes or modifications are intended to fall within the scope of the following claims.

What is claimed is:

1. A double sided table top display apparatus to be supported and secured to a new or existing table top, which comprises:

a) a first double sided upright sub-assembly, comprising front and back vertical tubular members, an upper connector secured to the upper end of the front and back vertical tubular members, and a lower connector secured to the lower end of the front and back vertical tubular members;

b) a first pivoting clamping arm rotatably secured beneath the lower connector of the first double sided upright sub-assembly, a depending lower extension extending beneath the back vertical tubular member, and a horizontal clamping arm pivotally secured to the depending lower extension, with a vertical aperture located near the distal end of the horizontal clamping arm, a threaded nut secured within the horizontal clamping arm in alignment with the vertical aperture, a threaded rod engaging the threaded nut and extending through the vertical aperture, a handle secured to the lower end of the threaded rod, the threaded rod sized to engage the bottom of the table top when the handle is tightened, and to clear the depending lip of the table top when the handle is loosened;

c) a second double sided upright sub-assembly, comprising front and back vertical tubular members, an upper connector secured to the upper end of the front and back vertical tubular members, and a lower connector secured to the lower end of the front and back vertical tubular members;

d) a second pivoting clamping arm rotatively secured beneath the lower connector of the second double sided upright sub-assembly, a depending lower extension extending beneath the back vertical tubular member of the second double sided upright sub-assembly, and a horizontal clamping arm pivotally secured to the depending lower extension, with a vertical aperture located near the distal end of the horizontal clamping arm, a threaded nut secured within the horizontal clamping arm in alignment with the vertical aperture, a threaded rod engaging the threaded nut, and extending through the vertical aperture, a handle secured to the lower end of the threaded rod, the upper end of the threaded rod sized to engage the bottom of the table top when the handle is tightened, and to clear the depending lip of the table top when the handle is loosened;

e) at least one upper horizontal cross member(s), the upper horizontal cross member(s) sized to extend between a connector secured to the upper end of the first double sided upright sub-assembly at one end, and to a connector secured to the upper end of the second double sided upright sub-assembly at the opposite end;

f) at least one lower horizontal cross member(s), the lower horizontal cross member(s) sized to extend between a lower connector secured to the lower end of the first double sided upright sub-assembly at one end, and to a lower connector secured to the lower end of the second double sided upright sub-assembly at the opposite end;

g) a flexible sheet material sized to be releasably secured to a table top display frame formed by the back vertical tubular member on the first double sided upright sub-assembly, the back vertical tubular member on the second double sided upright sub-assembly, the upper horizontal cross member and the lower horizontal cross member; and the horizontal clamping arms of the first and second double sided upright sub-assemblies are pivoted in relation to the respective first and second double sided upright sub-assemblies, to selectively position the clamp arms to avoid objects located on the underside of the table top.

2. The double sided table top display apparatus of claim 1, wherein each of the first and second double sided upright assemblies have one or more additional cross braces extending in spaced relation between the front vertical member and the back vertical member for additional strength and support.

3. The double sided table top display apparatus of claim 1, wherein each of the front vertical members and the back vertical members of the first and second double sided upright sub-assemblies are connected with a straight connector positioned between the upper connector and the lower connector to provide a more compact disassembly, for ease of transport and storage.

4. The double sided table top display apparatus of claim 1, wherein two end to end upper horizontal cross members are joined by a straight connector to provide a more compact disassembly, for ease of transport and storage.

5. The double sided table top display apparatus of claim 1, wherein at least one light fixture is releasably secured to at least one of the upper horizontal cross member, the upper connector of the first double sided upright sub-assembly and the upper connector of the second double sided upright sub-assembly to selectively illuminate the modular table top display apparatus during use.

6. The double sided table top display apparatus of claim 1, wherein a projection framework comprising an upper horizontal member, a lower horizontal member, a left side vertical member and a right side vertical member are joined together at their respective ends, each with right angle connectors, to form a projection framework, covered with a flexible screen, and removably mounted to one of the first and second double sided upright sub-assembly with a suitable fastener(s), to provide a projection screen suitable for viewing images projected thereon.

7. The double sided table top display apparatus of claim 1, wherein selected ends of releasably secured straight connectors, right angle connectors, three way connectors, tee connectors and four way connectors are molded, slotted, ground, cut or machined in at least one direction to provide a slip fit connection for ease of assembly and disassembly.

8. The double table top display apparatus of claim 1, wherein an elastomeric cord is secured between adjacent upper horizontal cross members and another elastomeric cord is secured between lower horizontal cross members for ease of alignment, assembly and disassembly, and for more compact shipping and storage.

9. The double table top display apparatus of claim 3, wherein the first double sided upright sub-assembly has an elastomeric cord extending between the upper and lower front vertical members, and the upper and lower back vertical members, and the second double sided upright sub-assembly has an elastomeric cord extending between the upper and lower front vertical members, and the upper and lower back vertical members for ease of alignment, assembly and disassembly, and for more compact shipping and storage.

10. A double sided table top display apparatus to be supported and secured to a new or existing table top, which comprises:

a) a first double sided upright sub-assembly, comprising front and back vertical tubular members, an upper connector secured to the upper end of the front and back vertical tubular members, a lower connector secured to the lower end of the front and back vertical tubular members, and at least one additional intermediate connector positioned in spaced relation between the upper connector and the lower connector on the first double sided upright sub-assembly;

b) a first pivoting clamping arm rotatively secured beneath the lower connector on the first double sided upright sub-assembly, the first clamping arm having a depending lower extension extending beneath the back vertical tubular member, and a horizontal clamping arm rotatably secured near one end to the depending lower extension, with a vertical aperture located near the distal end of the horizontal clamping arm, a threaded nut secured within the horizontal clamping arm in alignment with the vertical aperture, a threaded rod engaging the threaded nut, and extending through the vertical aperture, a handle secured to the lower end of the threaded rod, the threaded rod sized to engage the bottom of the table top when the handle is tightened, and to clear the depending lip of the table top when the handle is loosened;

c) a second double sided upright sub-assembly, comprising front and back vertical tubular members, an upper connector secured to the upper end of the front and back vertical tubular members, a lower connector secured to the lower end of at least one of the front and back vertical tubular members, and at least one additional intermediate connector positioned in spaced relation between the upper connector and the lower connector on the second double sided upright sub-assembly;

d) a second pivoting clamping arm rotatively secured beneath the lower connector on the second double sided upright sub-assembly, a depending lower extension extending beneath the back vertical tubular member, and a horizontal clamping arm pivotally secured near one end to the depending lower extension, with a vertical aperture located near the distal end of the horizontal clamping arm, a threaded nut secured within the horizontal clamping arm in alignment with the vertical aperture, a threaded rod engaging the threaded nut, and extending through the vertical aperture, a handle secured to the lower end of the threaded rod, the upper end of the threaded rod sized to engage the bottom of the table top when the handle is tightened, and to clear the depending lip of the table top when the handle is loosened;

e) at least one upper horizontal cross member, the upper horizontal cross member(s) sized to extend between a connector secured to the upper end of the first double sided upright sub-assembly and a connector secured to the upper end of the second double sided upright sub-assembly;

f) at least one lower horizontal cross member(s), the lower horizontal cross member(s) sized to extend between the lower connector secured to the lower end of the first double sided upright sub-assembly and the lower connector secured to the lower end of the second double sided upright sub-assembly;

g) a flexible sheet material sized to be releasably secured to a frame formed by the vertical tubular member on the first double sided upright sub-assembly, the vertical tubular member on the second double sided upright sub-assembly, the upper horizontal cross member and the lower horizontal cross member at assembly.

11. The double table top display apparatus of claim 10, wherein each of the front vertical members and the back vertical members of the first and second double sided upright sub-assemblies are formed with an upper vertical member and a lower vertical member joined by a suitable connector to extend the height of the respective first and second double sided upright sub-assemblies, and to provide a more compact disassembly, for ease of transport and storage.

12. The double sided table top display apparatus of claim 10, wherein two end to end upper horizontal cross members are joined by a straight connector and two end to end lower horizontal cross members are joined by a straight connector to extend the length of the double sided table top display apparatus, and to provide a more compact disassembly, for ease of transport and storage.

13. The modular table top display apparatus of claim 10, wherein at least one end of each straight connector, right angle connector, three way connector, tee connector and four way connector is molded, slotted, machined, or ground in at least one direction to provide a slip fit connection for ease of assembly and dis-assembly.

14. The double sided table top display apparatus of claim 10, wherein a projection framework comprising an upper horizontal member, a lower horizontal member, a left side vertical member and a right side vertical member are joined together at their respective ends, each with right angle connectors, to form a projection framework, and covered with a flexible screen, and removably mounted to one of the first and second double sided upright sub-assembly.

15. The double table top display apparatus of claim 10, wherein an elastomeric cord is secured between adjacent upper horizontal cross members and another elastomeric cord is secured between lower horizontal cross members for ease of alignment, assembly and disassembly, and for more compact shipping and storage.

16. The double table top display apparatus of claim 10, wherein the first double sided upright sub-assembly has an elastomeric cord extending between the upper and lower front vertical members, and the upper and lower back vertical members, and the second double sided upright sub-assembly has an elastomeric cord extending between the upper and lower front vertical members, and the upper and lower back vertical members for ease of alignment, assembly and disassembly, and for more compact shipping and storage.

17. The double sided table top display apparatus of claim 10, wherein the first clamping arm is rotatably secured with a bolt and a locknut beneath the first double sided upright sub-assembly, and the second clamping arm is rotatably secured with a bolt and a locknut beneath the second double sided upright sub-assembly.

18. A double sided table top display apparatus to be supported and secured to a new or existing table top, which comprises:

a) a first double sided upright sub-assembly, comprising an upper and lower front vertical tubular members, and upper and lower back vertical tubular members, the upper and lower front vertical tubular members joined by an elastomeric cord for ease of alignment and assembly, and an upper and lower back vertical tubular members joined by elastomeric cord for ease of alignment and assembly, an upper connector secured to the upper end of at least one of the front and back vertical tubular members, and a lower connector secured to the lower end of at least one of the front and back vertical tubular members;

b) a first clamping arm rotatively secured beneath the first double sided upright sub-assembly, the first clamping arm having a horizontal table top brace, a depending lower extension, and a horizontal clamping arm with a vertical aperture located near the distal end of the horizontal clamping arm, a threaded nut secured within the horizontal clamping arm in alignment with the vertical aperture, a threaded rod engaging the threaded nut, and extending through the vertical aperture, a handle secured to the lower end of the threaded rod, the threaded rod sized to engage the bottom of the table top when the handle is tightened, and to clear the depending lip of the table top when the handle is loosened;

c) a second double sided upright sub-assembly, comprising an upper and lower front vertical tubular members, and an upper and lower back vertical tubular members, the upper and lower front vertical tubular members joined by an elastomeric cord for ease of alignment and assembly, and the upper and lower back vertical tubular members joined by elastomeric cord for ease of alignment and assembly, an upper connector secured to the upper end of at least one of the front and back vertical tubular members, and a lower connector secured to the lower end of at least one of the front and back vertical tubular members;

d) a second clamping means rotatively secured beneath the second upright sub-assembly, the clamping means having a horizontal table top brace, a depending lower extension, and a horizontal clamping arm with a vertical aperture located near the distal end of the horizontal clamping arm, a threaded nut secured within the horizontal clamping arm in alignment with the vertical aperture, a threaded rod engaging the threaded nut, and extending through the vertical aperture, a handle secured to the lower end of the threaded rod, the upper end of the threaded rod sized to engage the bottom of the table top when the handle is tightened, and to clear the depending lip of the table top when the handle is loosened;

e) at least two end to end upper horizontal cross members, the upper horizontal cross member(s) sized to extend between the connector secured to the upper end of the first double sided upright sub-assembly and the connector secured to the upper end of the second double sided upright sub-assembly, and an elastomeric cord secured between the at least two upper horizontal cross members, for ease of alignment and assembly;

f) at least two end to end lower horizontal cross member(s), the lower horizontal cross member(s) sized to extend between the lower connector secured to the lower end of the first double sided upright sub-assembly and the lower connector secured to the lower end of the second double sided upright sub-assembly, the at least two lower horizontal cross members joined together with an elastomeric cord for ease of alignment and assembly, and sized to extend between the connector secured to the lower end of the first double sided upright sub-assembly and the connector secured to the lower end of the second double sided upright sub-assembly;

g) a flexible sheet material sized to be releasably secured to a frame formed by the vertical tubular member on the first double sided upright sub-assembly, the vertical tubular member on the second double sided upright sub-assembly, the upper horizontal cross member and the lower horizontal cross member at assembly, the upper and lower front vertical tubular members and the upper and lower rear vertical tubular members are used to extend the height of the respective first and second double sided upright sub-assemblies, and an elastomeric cord is secured between adjacent upper and lower vertical tubular members on the first double sided upright sub-assembly and the second double sided upright sub-assembly for ease of alignment and assembly, h) two end to end upper horizontal cross members and two end to end lower horizontal cross members are used to extend the length of the double sided table top display apparatus, and an elastomeric cord is secured between end to end horizontal cross members for ease of alignment and assembly, and to provide a more compact disassembly, for ease of transport and storage; and i) a removable projection screen is releasably secured to one of the first and second double sided upright sub-assemblies, the removable projection screen comprising a projection screen framework having an upper horizontal member, a lower horizontal member in spaced relation from the upper horizontal member, a left side vertical member and a right side vertical member in spaced relation from the left side vertical member, the upper and lower horizontal members joined by a right angle connection to respective left and right side vertical member to form the projection screen framework, and a flexible screen releasably secured to the projection screen framework and mounted to one of the first and second double sided upright sub-assemblies with a suitable releasable securement means.

19. The double sided table top display apparatus of claim 18, wherein the first clamping arm is rotatably secured with a bolt and a locknut beneath the first double sided upright sub-assembly, and the second clamping arm is rotatably secured with a bolt and a locknut beneath the second double sided upright sub-assembly.

* * * * *